US007171720B2

(12) United States Patent
Rust et al.

(10) Patent No.: US 7,171,720 B2
(45) Date of Patent: Feb. 6, 2007

(54) DEVICE FOR EXPELLING LIQUID FROM A WIPING ELEMENT

(75) Inventors: Hendrik Rust, Stuttgart (DE); Yunus Demirtas, Kornwestheim (DE); Ronald Schwarz, Winnenden (DE)

(73) Assignee: Alfred Kaercher GmbH & Co. KG., Winnenden (DE)

( * ) Notice: Subject to any disclaimer, the term of this patent is extended or adjusted under 35 U.S.C. 154(b) by 20 days.

(21) Appl. No.: 10/989,903

(22) Filed: Nov. 15, 2004

(65) Prior Publication Data

US 2005/0115098 A1 Jun. 2, 2005

Related U.S. Application Data

(63) Continuation of application No. PCT/EP03/04775, filed on May 7, 2003.

(30) Foreign Application Priority Data

May 24, 2002 (DE) ..... 102 23 074

(51) Int. Cl.
*A47L 13/58* (2006.01)

(52) U.S. Cl. ..... 15/260; 15/228; 34/58

(58) Field of Classification Search ..... 15/260, 15/3, 119.1, 119.2, 116.1, 228; 34/58
See application file for complete search history.

(56) References Cited

U.S. PATENT DOCUMENTS 2,741,244 A 4/1956 Trostler
4,464,809 A * 8/1984 Trisolini ..... 15/260
6,550,094 B1 * 4/2003 Hurtado ..... 15/119.2

FOREIGN PATENT DOCUMENTS

| | | |
|---|---|---|
| DE | 150022 | 4/1904 |
| DE | 29 05 319 | 8/1980 |
| EP | 0 667 114 | 8/1995 |
| JP | 03055022 | 3/1991 |
| WO | 92/14394 | 9/1992 |
| WO | 97/49327 | 12/1997 |
| WO | 99/17653 | 4/1999 |

* cited by examiner

*Primary Examiner*—Gary K. Graham
(74) *Attorney, Agent, or Firm*—Lipsitz & McAllister, LLC

(57) ABSTRACT

The invention relates to a device for expelling liquid from a wiping element which is held on a wiping head of a surface cleaning device so as to form a wiping surface, comprising a container, in which a wiping element holding device accommodating the wiping element as well as a driving device are arranged, wherein the wiping element holding device can be driven by means of the driving device so as to rotate about an axis of rotation. In order to further develop the device in such a manner that it has a lower consumption of energy it is suggested in accordance with the invention that the wiping element holding device form a receiving means, into which the wiping element can be inserted with a surface normal of the wiping surface aligned at an angle to the axis of rotation.

20 Claims, 4 Drawing Sheets

11
75
76
77
21
14

95
81
89
89
85
84
83
82
86
87
55

81
80
83
85
84
82
86
87
89
88

DEVICE FOR EXPELLING LIQUID FROM A WIPING ELEMENT

This application is a continuation of International Application No. PCT/EP03/04775 filed on May 7, 2003.

The present disclosure relates to the subject matter disclosed in International application No. PCT/EP03/04775 of May 7, 2003, which is incorporated herein by reference in its entirety and for all purposes.

BACKGROUND OF THE INVENTION

The invention relates to a device for expelling liquid from a wiping element which is held on a wiping head of a surface cleaning device so as to form a wiping surface, comprising a container, in which a wiping element holding device accommodating the wiping element as well as a driving device are arranged, wherein the wiping element holding device can be driven by means of the driving device so as to rotate about an axis of rotation.

For the purpose of cleaning a soiled surface, in particular, a floor surface, a wiping element, for example, a wiping pad or a wiper covering is often used which is held on a wiping head so as to form a wiping surface. For the purpose of cleaning, the wiping element is moved with its wiping surface along the surface to be cleaned and dirt is thereby taken up. Subsequently, the wiping element is normally rinsed out and wrung out.

In WO 92/14394 A it is suggested for the purpose of wringing out that the wiping element be placed on a wiping element holding device which is subsequently caused to rotate so that liquid is expelled from the wiping element on account of the acting centrifugal forces. Such a procedure has the advantage that the user does not come into contact with the cleaning liquid. The known device does, however, require a not inconsiderable consumption of energy in order to remove moisture from the wiping element reliably.

It is the object of the present invention to further develop a device of the type specified at the outset in such a manner that the removal of moisture from a wiping element can take place with a lower consumption of energy.

SUMMARY OF THE INVENTION

This object is accomplished in accordance with the invention, in a device of the generic type, in that the wiping element holding means forms a receiving means, into which the wiping element can be inserted with a surface normal of the wiping surface aligned at an angle to the axis of rotation.

In accordance with the invention, the wiping element holding device holds the wiping element within the container with a wiping surface aligned at an angle, i.e., inclined or at right angles to the axis of rotation, i.e., the surface normal of the wiping surface is not aligned parallel to the axis of rotation but is at an angle to the axis of rotation. It has been shown that drops of liquid can be expelled from the wiping surface particularly effectively with such an alignment. The inventive device is therefore characterized by a high degree of efficiency. This makes it possible to achieve an effective removal of moisture from the wiping element even with a relatively low rotational speed and, consequently, with a relatively low consumption of energy.

It has proven to be advantageous when the receiving means accommodates the wiping element with a surface normal of the wiping surface aligned at right angles to the axis of rotation. This makes a particularly compact form of the expelling device possible. In addition, plate-like wiping elements, which form a wiping surface not only on their upper side but also on their underside and, consequently, can be used on two sides, may have moisture removed from them in an advantageous manner with such a design. Wiping elements of this type are normally held on a wiping element carrier, to which a handle or grip is articulatedly connected at one side. The wiping element carrier with the wiping element held thereon can be pivoted relative to the handle in such a manner that the upper side or alternatively the underside of the wiping element carrier faces the surface to be cleaned. This pivotable mounting of the wiping element carrier on the handle makes it easier to insert the wiping element carrier into the receiving means of the wiping element holding device together with the wiping element held thereon in such a manner that the surface normal of the wiping surface is aligned at right angles to the axis of rotation of the expelling device.

In order to simplify the handling it is advantageous when the receiving means comprises a guide, into which the wiping element can be inserted. The insertion of the wiping element is made easier by the guide.

The guide preferably has two U-shaped guiding elements which extend parallel to one another and accommodate the wiping element between them. The guiding elements are preferably held at the ends, which face away from one another, of a guiding support which is aligned parallel to a base surface of the container.

The wiping element may be inserted into the receiving means of the wiping element holding device particularly easily when the guiding elements are aligned parallel to the axis of rotation.

It may be provided for the wiping element holding device to be caused to rotate manually. For this purpose, the driving device coupled to the wiping element holding device can have mechanical driving elements with a crank handle or a foot pedal which can be actuated by the user of the expelling device. It is particularly favorable when the driving device has mechanical deflection elements for turning a translatory movement of the foot pedal into a rotational movement of the wiping element holding device.

Alternatively, it may be provided for the driving device to comprise a drive motor, preferably an electric motor.

In this respect, it is favorable when a rechargeable energy supply unit is associated with the drive motor. This makes a self-sufficient operation of the expelling device possible without any mains power supply needing to be ensured.

In a particularly preferred embodiment of the invention it is provided for the driving device to be arranged within the container beneath the wiping element holding device and preferably at a distance to a base wall of the container. The area beneath the driving device can, consequently, serve as a compartment for receiving the liquid expelled from the wiping element.

Alternatively, it may be provided for the driving device to be arranged on the base wall of the container, wherein the driving device does not cover the entire area of the base wall and so a compartment for receiving the expelled liquid may be provided within the container to the side next to the driving device. The driving device held on the base wall can also be positioned at a distance to the wiping element holding device, thereby forming the receiving compartment between the two components.

It is favorable when the rotational speed of the wiping element holding device can be adjusted. This offers the possibility of setting different rotational speeds depending on the desired degree of moistness which the wiping element is intended to have following the expelling. For example, a selection switch may be provided, with which the user can select a specific rotational speed.

Alternatively, it may be provided for the rotational speed to be adjustable infinitely, for example, in a range between 250 revolutions per minute and 500 revolutions per minute.

It has proven to be favorable when a maximum spinning time of the wiping element holding device can be predetermined, after the termination of which the rotary drive of the wiping element holding device can be switched off automatically. It may, for example, be provided for the user to be able to choose between different spinning times by means of a selection switch. Particularly when a rotational speed is predetermined, the selection of the spinning time gives the user the possibility of setting the degree of moistness of the wiping element as required.

In this respect, it has proven to be favorable when the spinning time is adjustable infinitely.

When an electric drive motor is used, it has proven to be favorable when the wiping element holding device has a switching element which activates the rotary drive after the wiping element has been successfully inserted into the wiping element holding device. A push-button switch is preferably used as switching element. It has proven to be particularly favorable when the switching element can be actuated without contact, for example, it can be designed as a reed contact. Alternatively or in addition to a switching element which activates the rotary drive automatically and preferably interacts with the wiping element holding device, the use of a switch which can be actuated manually by the operator of the expelling device may be provided, for example, in the form of a master switch or an emergency shutdown switch.

In order to reduce the risk of injury during any inexpert handling of the expelling device, it is provided in one advantageous embodiment for the wiping element holding device to be coupled to the driving device via a slip coupling. This offers the possibility of securing the wiping element holding device when the driving device is active without any risk of injury resulting from this.

In a particularly preferred embodiment, the container comprises a partition wall for dividing the container into a spinning area accommodating the wiping element holding device and a washing area accommodating the cleaning liquid for washing the wiping element. This gives the user the possibility, during the cleaning, of first dipping the wiping element several times into the cleaning liquid and, therefore, of washing the wiping element. Subsequently, the wiping element can be inserted into the wiping element holding device in the spinning area and caused to rotate in order to expel the cleaning liquid.

In this respect, it is of advantage for achieving a particularly compact construction when the spinning area accommodates not only the wiping element holding device but also the driving device. Alternatively it may be provided for the driving device to be positioned within the washing area and to be connected to the wiping element holding device arranged in the spinning area via coupling elements.

Alternatively or in addition to a washing area, it is provided in a preferred embodiment for the device to comprise a spraying device for spraying the wiping element inserted into the wiping element holding device. This offers the possibility of spraying the wiping element with cleaning liquid, wherein it is caused to rotate at the same time. It may, for example, be provided for the wiping element to be turned first of all with a low rotational speed and be sprayed with cleaning liquid at the same time and for the cleaning liquid to subsequently be expelled from the wiping element at a higher rotational speed.

The spraying device preferably comprises at least one spray nozzle which is in flow communication with a conveyor pump. In this respect, it is favorable when liquid from an area beneath the wiping element holding device can be pumped to the spray nozzle by means of the conveyor pump. As a result, liquid which has been expelled from the wiping element in a preceding spinning procedure can be sprayed onto the wiping element for the purpose of washing in a subsequent spinning procedure.

In order to achieve a particularly effective washing process by means of the spraying device, it is favorable when the expelling device comprises a storage compartment for unused cleaning liquid and when liquid from the storage compartment can be pumped to the spray nozzle by means of the conveyor pump. As a result, the wiping element can be sprayed with unused cleaning liquid for the purpose of washing.

It is of particular advantage when the container of the expelling device can be closed by means of a container cover. As a result, not only can the risk of a user reaching into the container by mistake during the rotation of the wiping element holding device be reduced but this also offers the possibility of switching the driving device on and off as a function of the position of the container cover in that the container cover interacts with an electric switching element. The container cover can, for example, be articulatedly connected to the container and the switching element can be designed as a push button which switches the driving motor on when the container cover is closed and which switches the drive motor off when the container cover is opened.

The following description of preferred embodiments of the invention serves to explain the invention in greater detail in conjunction with the drawings.

DETAILED DESCRIPTION OF THE INVENTION

Figure 1:
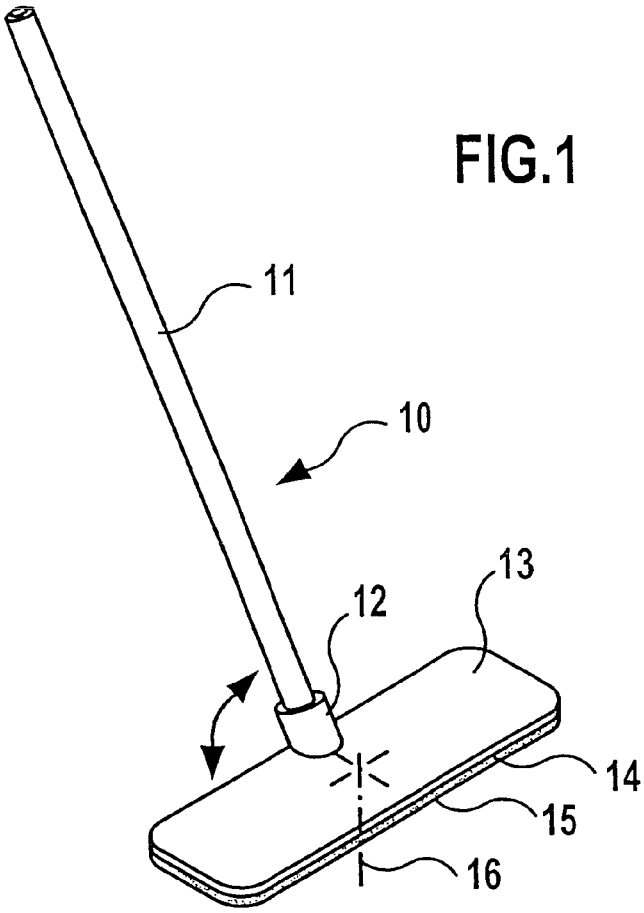
FIG. 1: shows a diagrammatic illustration of a floor cleaning device with a wiping element held on a wiping element carrier.

A floor cleaning device 10 which is known per se is illustrated in FIG. 1 in a schematic representation with a handle 11 which is connected via a joint 12 to a wiping head in the form of a plate-like wiping element carrier 13, a wiping element 14 being secured to its underside facing away from the handle 11. The wiping element can, for example, be a wiper covering which can be removed from the wiping element carrier 13. The wiping element 14 forms with its underside facing away from the wiping element carrier 13 a wiping surface 15 which can be moved along a floor surface to the cleaned for the purpose of taking up dirt and the alignment of which is predetermined by a surface normal 16 aligned at right angles to the wiping surface 15.

Floor surfaces may be cleaned in the customary manner by means of the floor cleaning device 10. For this purpose, the wiping element 14 is moistened and, subsequently, moved along the floor surface to be cleaned so that, for example, dust can be taken up from the floor surface. Subsequently, the wiping element 14 is washed out and wrung out so that it has only a slight degree of moistness.

Figure 2:
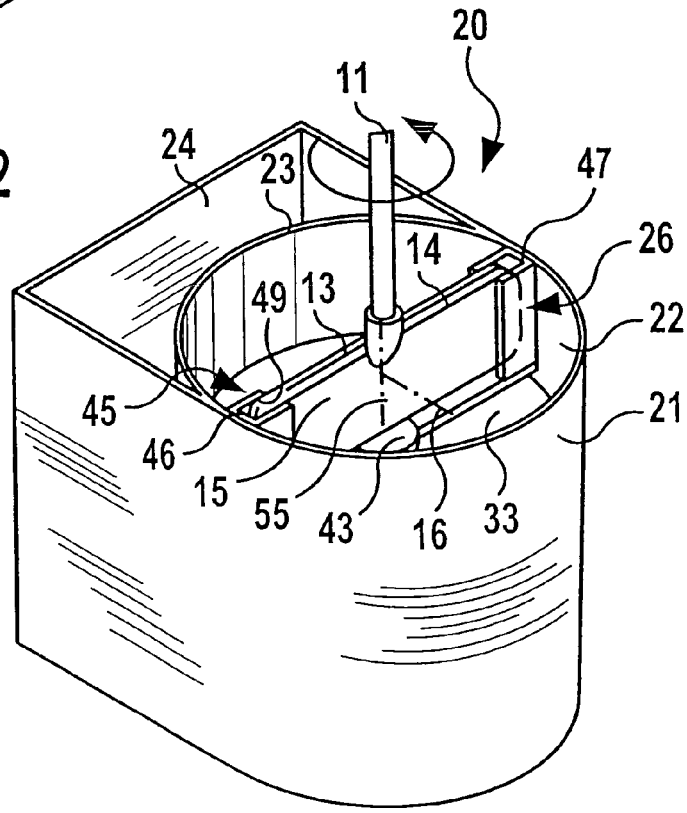
FIG. 2: shows a diagrammatic illustration of a first embodiment of a device for expelling liquid from the wiping element.

For the purpose of removing moisture from the wiping element 14, the device for expelling liquid from the wiping element 14, which is illustrated schematically in FIG. 2 and designated altogether with the reference numeral 20, is used in accordance with the invention. It comprises a container 21 with a spinning area 22 which has a circular cylindrical design and is separated from a washing area 24 by a partition wall 23. For the purpose of removing moisture, the wiping element carrier 13 with the wiping element 14 held thereon can be inserted into a wiping element holding device 26 within the spinning area 22 and, subsequently, caused to rotate so that the liquid absorbed by the wiping element 14 is subjected to a centrifugal force and is expelled from the wiping element 14 to a great extent.

Figure 3:
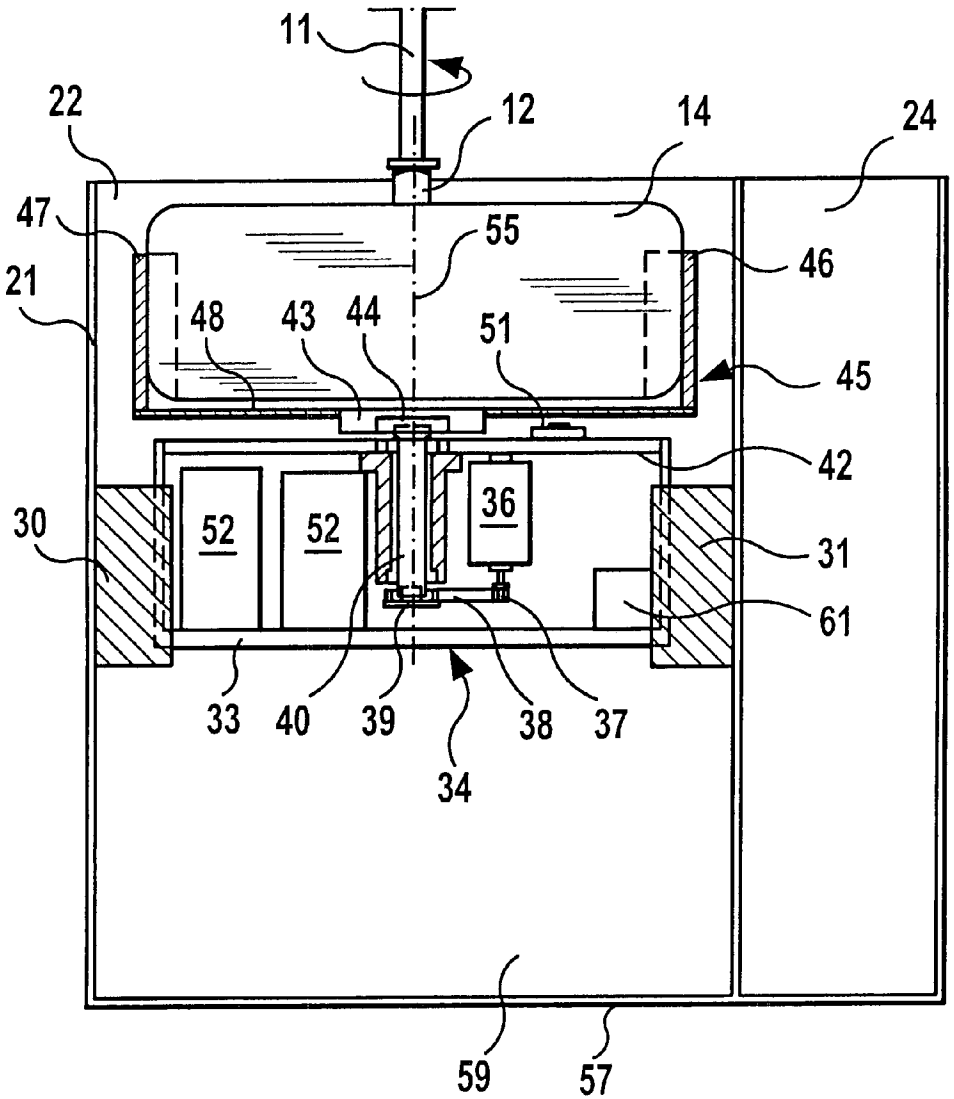
FIG. 3: shows a sectional illustration of the device for expelling liquid in accordance with FIG. 2.

The construction of the expelling device 20 is apparent, in particular, from the sectional illustration in accordance with FIG. 3. Two supports 30, 31 are secured to the inner wall of the container 21 diametrically opposite to one another within the spinning area 22 of the container 21 approximately at half its height and these supports accommodate between them a water-tight housing 33 of a driving device 34. The supports 30 and 31 form for this purpose receiving grooves which are known per se, are not illustrated in the drawings and into which the housing 33 can be inserted from above and also removed again when required.

The driving device 34 comprises an electric drive motor 36 which is coupled via a belt disk 37 and a toothed belt 38 to a toothed belt disk 39 which is held on a drive shaft 40 so as to be non-rotatable. The drive shaft projects with its end facing away from the toothed belt disk 39 beyond a cover 42 of the housing 33 and bears an intermediate member 43, on which a wiping element holding device 45 is seated which is connected to the intermediate member 43 so as to be non-rotatable, via a slip coupling 44 which is known per se and, therefore, illustrated only schematically in the drawings.

The wiping element holding device 45 comprises two U-shaped guide parts 46, 47 which are aligned parallel to one another and are rigidly connected to one another via a cross bar 48 connected to the intermediate member 43 so as to be non-rotatable. The guide parts 46 and 47 define a receiving means 49 of the wiping element holding device 45, into which the wiping element carrier 13 can be inserted in a vertical direction together with the wiping element 14 held thereon.

The drive shaft 40 is spring-mounted in axial direction so that the wiping element holding device 45 which is held on the drive shaft 40 via the slip coupling 44 and the intermediate member 43 can be moved in the direction towards the water-tight housing 33 contrary to an elastic spring force. A push-button switch 51 is arranged between the cross bar 48 of the wiping element holding device 45 and the housing 33 on the upper side of the housing and is in communication with the electric motor 36 via electric lines which are known per se and not illustrated in the drawings. The push-button switch 51 can be actuated due to movement of the wiping element holding device 45 in the direction towards the housing 33. Alternatively to the positioning of the push-button switch 51 on the upper side of the housing, a non-contact proximity switch, for example, a reed contact could be arranged within the water-tight housing 33 and be actuatable when the wiping element holding device 45 approaches the housing 33. As a result, water-tight, electric passageways through the housing 33 to a switching element positioned outside the housing could be dispensed with.

In order to supply energy to the electric motor 36, two rechargeable batteries 52, which enable a self-sufficient operation of the expelling device 20, are arranged within the housing 33 of the driving device 34. Alternatively or in addition, it may be provided for the energy to be supplied via a connection cable which can be connected to a mains power supply.

The drive shaft 40 can be caused to rotate about its longitudinal axis by means of the electric motor 36, i.e., the longitudinal axis of the drive shaft 40 defines an axis of rotation 55 of the expelling device 20. The axis of rotation 55 is aligned coaxially to the axis of symmetry of the circular-cylindrical spinning area 22.

The wiping element carrier 13 with the wiping element 14 held thereon is inserted into the receiving means 49 of the wiping element holding device 55 in such a manner that the surface normal 16 of the wiping surface 15 is aligned at right angles to the axis of rotation 55. This is apparent, in particular, from FIG. 2.

During the insertion of the wiping element carrier 13 and the wiping element 14 into the wiping element holding device 55, the push-button switch 51 can be actuated, as explained in the above. This causes the electric motor to be switched on and, as a result, the wiping element holding device 45 is caused to rotate via the drive shaft 40. Any liquid absorbed by the wiping element 14 experiences a centrifugal force on account of the rotary movement and so it is expelled from the wiping element 14 in a radial direction and impinges on the inner side of the wall of the container 21. The liquid expelled subsequently flows along the container wall in the direction of the base wall 57 of the container 21. In the area between the base wall 57 and the supports 30, 31 of the driving device 34, the spinning area 22 forms a compartment 59 for receiving liquid, in which the liquid expelled from the wiping element 13 collects.

If the user lifts the wiping element carrier 13 together with the wiping element 14 away from the push-button switch 51 by means of the handle 11, the supply of energy to the electric motor 36 is interrupted and, as a result, the rotational movement is terminated. The wiping element carrier 13 can be removed from the receiving means 49 of the wiping element holding device 45 together with the wiping element 14.

The rotational speed of the wiping element holding device 45 can be adjusted continuously by the user between a value of approximately 250 revolutions per minute up to approximately 500 revolutions per minute so that the user can predetermine the degree of moistness of the wiping element 14 as required following a successful spinning procedure. For this purpose, a rotary switch is used which is known per se and not, therefore, illustrated in the drawings and which is coupled to a control unit 61 of the driving device 34 arranged within the housing 33. The rotational speed of the drive motor 36 can be continuously adjusted by means of the control unit 61.

As already explained, the container 21 comprises in addition to the spinning area 22 a washing area 24. The washing area 24 can be filled with unused cleaning liquid for the purpose of washing the wiping element 14. This is, for this purpose, dipped several times into cleaning liquid within the washing area 24. Subsequently, the wiping element 14 can then have moisture removed from it in the spinning area 22.

Figure 4:
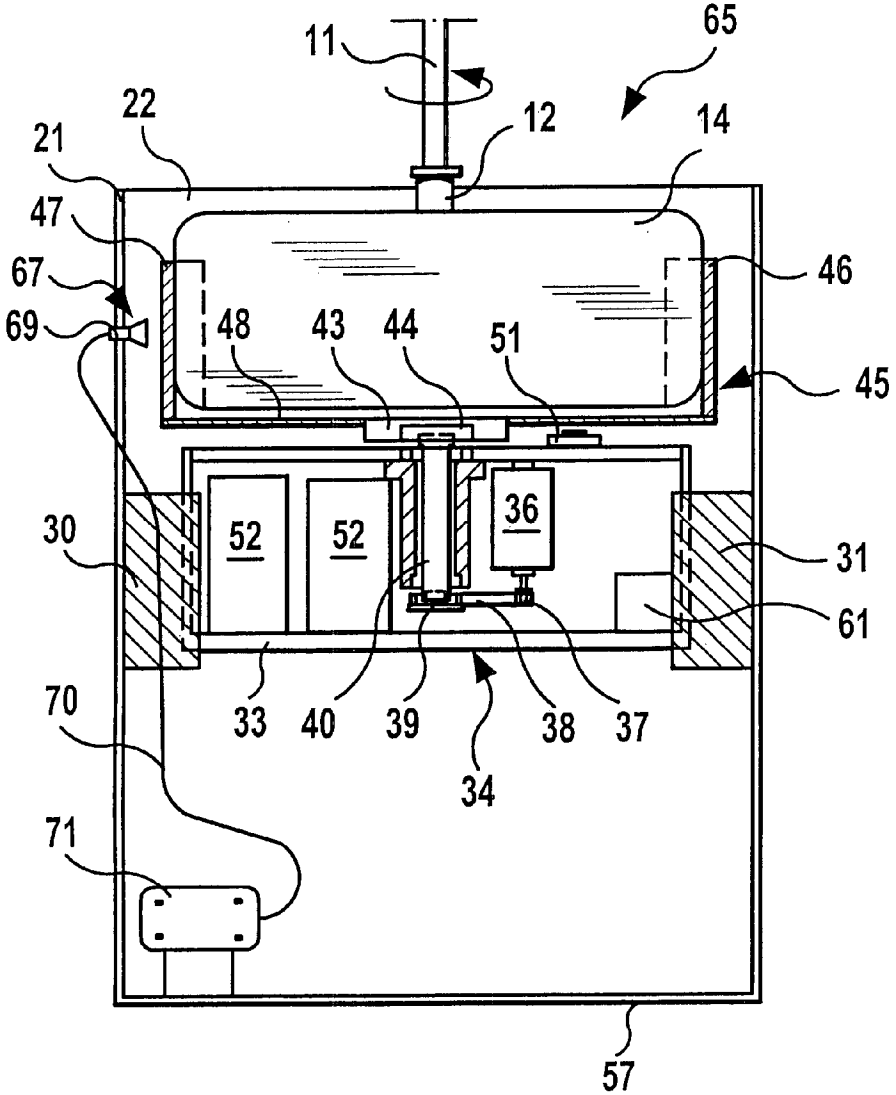
FIG. 4: shows a sectional illustration of a second embodiment of a device for expelling liquid from the wiping element.

A second embodiment of an inventive expelling device is illustrated in FIG. 4 and designated altogether with the reference numeral 65. This has to a great extent the same construction as the expelling device 20 explained in the above. Therefore, the same reference numerals as in FIGS. 1, 2 and 3 are used for identical components. In this respect, reference is made in full to the preceding explanations.

The expelling device 65 differs from the expelling device 20 presented in the above with reference to FIGS. 2 and 3 in that a separate washing area 24 for washing the wiping element 14 is omitted. Instead, the expelling device 65 has a spraying device 67 with a spray nozzle 69 secured to the inner side of the wall of the container 21 at the height of the guide parts 46, 47. This spray nozzle is in flow communication with a conveyor pump 71 arranged on the base wall 57 within the compartment 59 for receiving liquid via a hose 70. Liquid may be drawn out of the compartment 59 for receiving liquid and pumped to the spray nozzle 69 by means of the conveyor pump 71. This offers the user the possibility of inserting the wiping element carrier 13 into the wiping element holding device 45 together with the wiping element 14 and of spraying it first of all with cleaning liquid during a slow rotation of the wiping element holding device 45 in order to wash the wiping element 14. Subsequently, the rotational speed of the wiping element holding device 45 can be increased, wherein the conveyor pump 71 is switched off at the same time so that the wiping element 14, as explained in the above, can have moisture removed from it.

Figure 5:
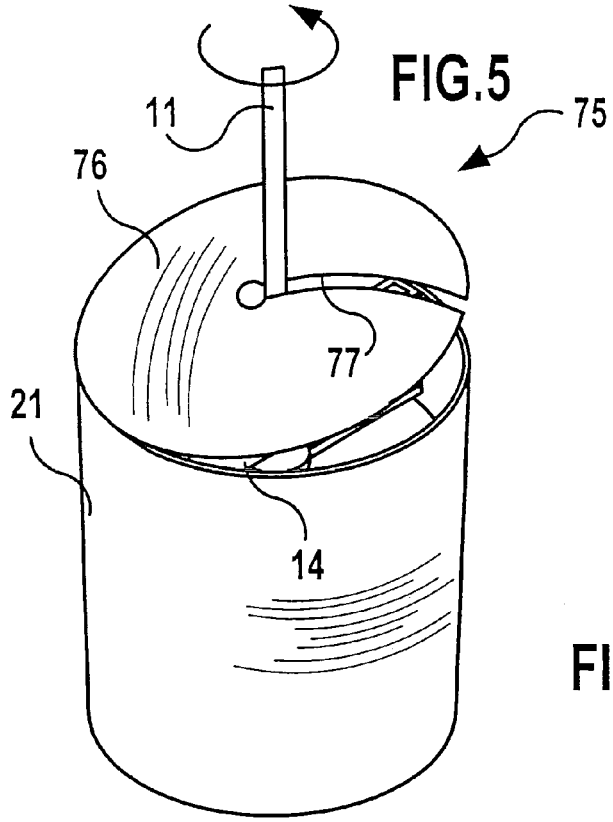
FIG. 5: shows a schematic illustration of a third embodiment of a device for expelling liquid from the wiping element.

In FIG. 5, a further embodiment of an inventive expelling device is illustrated which is designated as a whole with the reference numeral 75. This differs from the expelling device 65 explained in the above merely due to the additional use of a container cover 76 which is articulatedly connected to the upper side of the container 21 and has a receiving slot 77 which extends radially and through which the handle 11 of the floor cleaning device 10 can pass once the wiping element carrier 13 has been inserted into the wiping element holding device 45 together with the wiping element 14. The container 21 may be closed by means of the container cover 76 so that the risk is reduced of liquid exiting from the container 21 or of the user reaching into the container 21 by mistake during the rotation of the wiping element holding device 45. The use of the container cover 76 also offers the possibility of using, instead of the push-button switch 51, a contact switch which cooperates with the container cover 76, is not illustrated in the drawings and can be actuated by the container cover 76. If the container cover 76 is closed, the electric motor 36 is switched on via the contact switch and when the container cover is opened, the electric motor is switched off.

In the case of the floor cleaning device presented in the above with reference to FIG. 1, the wiping element carrier 13 is of a plate-like or frame-like design and the handle 11 is articulatedly connected to the wiping element carrier 13 in the area of a transverse edge of the wiping element carrier.

Figure 6:
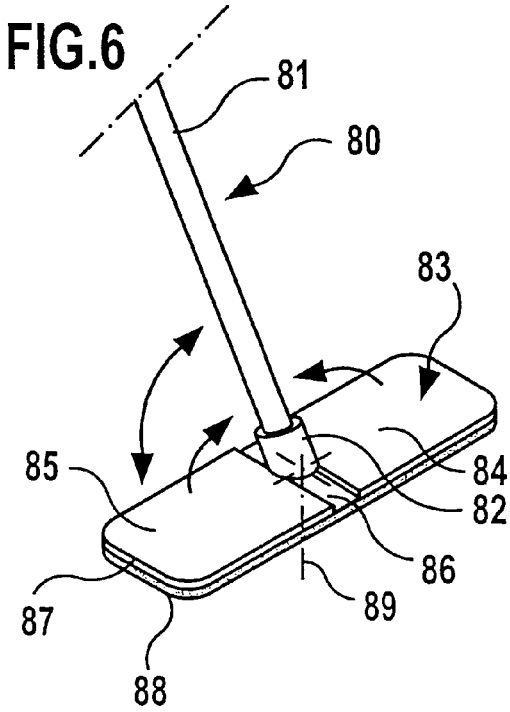
FIG. 6: shows a diagrammatic illustration of an alternative design of a floor cleaning device with a folding wiping element

In FIG. 6, an alternative design of a floor cleaning device which is likewise known per se is illustrated and designated as a whole with the reference numeral 80. It likewise comprises a handle 81 which is held on a wiping, element carrier 83 via a joint 82. The wiping element carrier is designed in two parts and comprises two carrier halves 84, 85 which are coupled to one another via a hinge 86 which can be locked by the user. On its underside, the wiping element carrier 83 bears a wiping element 87 which defines a rectangular wiping surface 88 facing away from the handle 81 and having a surface normal 89.

Figure 7:
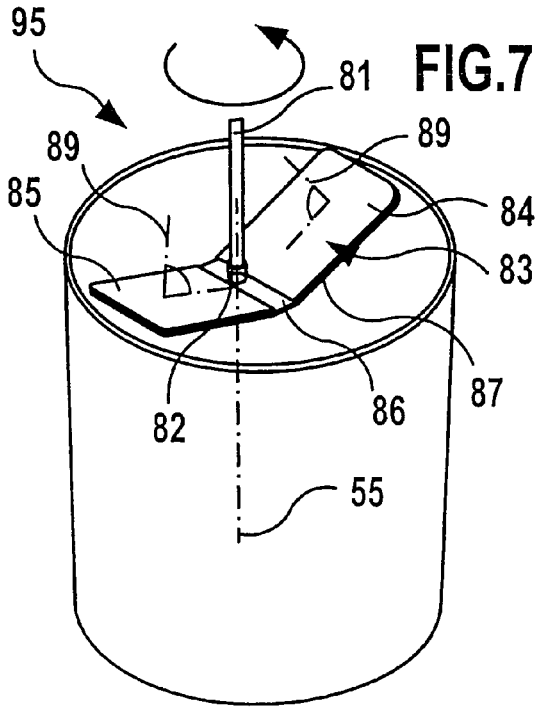
FIG. 7: shows a diagrammatic illustration of a fourth embodiment of a device for expelling liquid from the wiping element in accordance with FIG. 6.

In order to remove moisture from the wiping element 87, the handle 81 can be pivoted upwards into a position aligned parallel to the surface normal 89 and, subsequently, the locking mechanism of the hinge 86 which is known per se and not illustrated in the drawings can be released by the user so that the two carrier halves 84 and 85 may be pivoted upwards in the direction towards the handle 81. In accordance with the preceding explanations, the wiping element carrier 83 can then be inserted into a corresponding wiping element holding device of a fourth embodiment of an invention expelling device 95 illustrated in FIG. 7 with carrier halves 84 and 85 pointing upwards at an angle and surface normals 89 of the wiping element 87 aligned accordingly at an angle to the axis of rotation 55. The expelling device 95 is to a great extent identical to the expelling device 65 explained in the above with reference to FIG. 4. It is, therefore, illustrated in FIG. 7 in an extremely simplified manner. It differs from the expelling device 65 merely due to the special adaptation of the wiping element holding device 45 to the folding wiping element carrier 83. As already explained, the two carrier halves 84 and 85 can be pivoted upwards. This offers the possibility of inserting the areas of the wiping surface 88 associated with a respective carrier half 84 or 85 into the wiping element holding device of the expelling device 95 with surface normals 89 aligned at an angle to the axis of rotation 55. Subsequently, the wiping element carrier 83 is caused to rotate together with the wiping element 87 held thereon in the manner already explained in the above. The expelling device accommodating the wiping element carrier 83 can be designed so as to be very compact and have a small constructional size on account of the folding design of the wiping element carrier 83.

The invention claimed is:

1. Device for expelling liquid from a wiping element held on a wiping element carrier of a surface cleaning device so as to form a wiping surface, comprising:

a container, a wiping element holding device arranged in the container for accommodating the wiping element carrier with the wiping element, the wiping element holding device further including receiving means on opposed portions of the holding device for receiving opposed ends of the wiping element carrier, a driving device arranged in said container, the wiping element holding device being drivable by means of the driving device so as to rotate about an axis of rotation of the driving device, the wiping element carrier with the wiping element being insertable into said receiving means with a surface normal of the wiping surface aligned at an angle to the axis of rotation.

2. Device as defined in claim 1, wherein the receiving means accommodates the wiping element carrier with the wiping element with a surface normal of the wiping surface aligned at right angles to the axis of rotation.

3. Device as defined in claim 1, wherein the receiving means comprises a guide, the wiping element carrier with the wiping element being insertable into said guide.

4. Device as defined in claim 3, wherein the guide has two U-shaped guiding elements extending parallel to one another for accommodating the wiping element carrier with the wiping element between them.

5. Device as defined in claim 4, wherein the guiding elements are aligned parallel to the axis of rotation.

6. Device as defined in claim 1, wherein the driving device comprises a drive motor.

7. Device as defined in claim 6, wherein the driving device comprises a rechargeable energy supply unit.

8. Device as defined in claim 1, wherein the driving device is arranged beneath the wiping element holding device at a distance in relation to a base wall of the container.

9. Device as defined in claim 1, wherein the rotational speed of the wiping element holding device is adjustable.

10. Device as defined in claim 9, wherein the rotational speed of the wiping element holding device is adjustable infinitely.

11. Device as defined in claim 1, wherein a maximum spinning time of the wiping element holding device is predeterminable.

12. Device as defined in claim 11, wherein the spinning time is adjustable infinitely.

13. Device as defined in claim 1, wherein the wiping element holding device is coupled to the driving device via a slip coupling.

14. Device as defined in claim 1, wherein the container has a partition wall for dividing the container into a spinning area accommodating the wiping element holding device and a washing area accommodating a cleaning liquid for washing the wiping element.

15. Device as defined in claim 14, wherein the spinning area accommodates not only the wiping element holding device but also the driving device.

16. Device as defined in claim 1, wherein the device comprises a spraying device for spraying the wiping element inserted into the wiping element holding device.

17. Device as defined in claim 16, wherein the spraying device comprises at least one spray nozzle, said nozzle being in flow communication with a conveyor pump.

18. Device as defined in claim 17, wherein liquid from an area beneath the wiping element holding device can be pumped to the spray nozzle by means of the conveyor pump.

19. Device as defined in claim 17, wherein the device comprises a storage compartment for unused cleaning liquid and wherein liquid from the storage compartment can be pumped to the spray nozzle by means of the conveyor pump.

20. Device as defined in claim 1, wherein the container is closable by means of a container cover, wherein the container cover interacts with an electric switching element for switching the driving device on and off as a function of the position of the container cover.

* * * * *

UNITED STATES PATENT AND TRADEMARK OFFICE

CERTIFICATE OF CORRECTION

PATENT NO. : 7,171,720 B2
APPLICATION NO. : 10/989903
DATED : February 6, 2007
INVENTOR(S) : Rust et al.

It is certified that error appears in the above-identified patent and that said Letters Patent is hereby corrected as shown below:

On the Title Page
(73) Assignee: delete the "." after "KG"

Signed and Sealed this

Twelfth Day of June, 2007

JON W. DUDAS
*Director of the United States Patent and Trademark Office*